United States Patent [19]

Meadors

[11] 3,983,827

[45] Oct. 5, 1976

[54] TAB SCORING FOR CONTAINERS AND LIDS

[75] Inventor: William R. Meadors, Marion, Ind.

[73] Assignee: Peerless Machine & Tool Corporation, Marion, Ind.

[22] Filed: Dec. 5, 1975

[21] Appl. No.: 638,051

[52] U.S. Cl. ..... 113/121 A; 113/1 F; 113/15 A; 113/121 C

[51] Int. Cl.[2] ..... B21D 51/26

[58] Field of Search ..... 113/15 R, 15 A, 121 C, 113/121 A, 1 F; 220/48, 54; 53/133

[56] References Cited

UNITED STATES PATENTS

| | | | |
|---|---|---|---|
| 3,352,268 | 11/1967 | Koll | 113/121 A |
| 3,824,941 | 7/1974 | Hannon | 113/15 A |
| 3,868,919 | 3/1975 | Schrecker et al. | 113/121 C |

*Primary Examiner*—Willie G. Abercrombie
*Attorney, Agent, or Firm*—Jenkins, Hanley & Coffey

[57] ABSTRACT

Method and apparatus for scoring one or more lines into the surface of a plastic part such as a container or container lid as the part is being formed. A forming press includes a plurality of die members adapted for movement within, and with respect to, a plurality of draw pads. A blank of sheet stock is placed between die members and draw pads. The die members are then moved relative to the draw pads to draw the radially outer periphery of the blank across the draw pads to form the part. As the part is being formed, scoring knives positioned in at least one of the draw pads and having scoring edges which extend above the draw pad surfaces are held against the surface of the part. As the part is drawn across the surfaces of the draw pads, it is scored in a manner determined by the locations and orientations of the scoring knives in the draw pad and the manner in which the part surface is drawn across the scoring edges.

25 Claims, 11 Drawing Figures

TAB SCORING FOR CONTAINERS AND LIDS

This invention relates to methods of, and apparatus for, scoring a sheet of material as the sheet of material is being formed into a part such as a container or a lid for a container. The method and apparatus will be described in the context of cold-forming plastic sheet material between dies. It is to be understood, however, that the invention is not limited to plastic and, in fact, the method and apparatus may be applied to methods and apparatus other than cold-forming methods and apparatus.

This specification deals specifically with methods and apparatus for forming, for example, pull-tabs in thermoplastic sheet stock as the sheet stock is being cold-formed to provide a container part such as, for example, a lid or dish. One method for cold-forming thermoplastic sheet with which the present invention may be used is described in greater detail in my co-pending U.S. patent application Ser. No. 619,377 filed Oct. 3, 1975, titled Method and Apparatus for Cold-Forming Plastic Sheet and assigned to the assignee of this application.

Reference is here made to U.s. Pat. Nos. 3,584,109 issued June 8, 1971; 3,634,579 issued June 11, 1972; and 3,751,552 issued Aug. 7, 1973. These prior U.S. patents, issued to me as a sole or joint inventor, deal with methods and apparatus for cold-forming thermoplastic sheet materials to provide containers and parts thereof such as lids. These prior art patents deal with processes generally of the type discussed herein and serve further to explain such terms as "draw pad", "die member" and the like. Further in this regard, reference is made to U.S. Pat. Nos. 3,231,937 issued Feb. 1, 1966; 3,248,000 issued Apr. 26, 1966; and 3,276,616 issued Oct. 4, 1966, all to R. D. Lurie.

One thermoplastic material with which my said co-pending application deals and with which the present invention may be used is known commercially as Acrylonitrile Butadiene Styrene (ABS). Although ABS sheet stock is presently believed to be ideal for cold-forming, it will be appreciated that other plastic such as polystyrene, polypropylene and polycarbonate and some metal and paper sheet stock may be scored to provide a pull-tab or the like by the method and apparatus disclosed in this application. Scoring in accordance with the method and apparatus of the present invention may be accomplished also on composite sheet stock such as composite aluminum and paper, aluminum and plastic or paper and plastic.

It is therefore an object of the present invention to provide, in an apparatus for forming sheet stock into a part such as a dish or lid, which apparatus includes a plurality of die members housed within, and movable with respect to, a pair of draw pads, means for scoring the sheet stock as it is drawn between the draw pads during forming of the part. The scoring means may include one or more scoring knives disposed in one or both draw pads.

It is further an object of the present invention to score sheet stock as it is being formed into a part such as a container or lid for a container by such placement of scoring knives in one or more such draw pads and controlling the pressure of the surfaces of the said draw pads between which the sheet stock is being drawn, thereby controlling precisely the depth of scoring of the part.

An additional object of the present invention is to provide a method for scoring a sheet as the sheet is being formed into such a part, the method comprising the steps of engaging the sheet between opposed die members, the die members being held within and movable with respect to draw pads between which the sheet is drawn during formation of the part, and at least one of the draw pads having scoring means mounted therein, moving the die members to form the part and to draw the sheet between the draw pads, and scoring the sheet as the part is formed by drawing the sheet past the scoring means.

Other and further objects of the invention will become apparent to those skilled in the art to which the invention pertains by referring to the following description and accompanying drawings of which:

In the drawings, those features which are indicated by the same reference numerals perform the same or similar functions.

Figure 1:
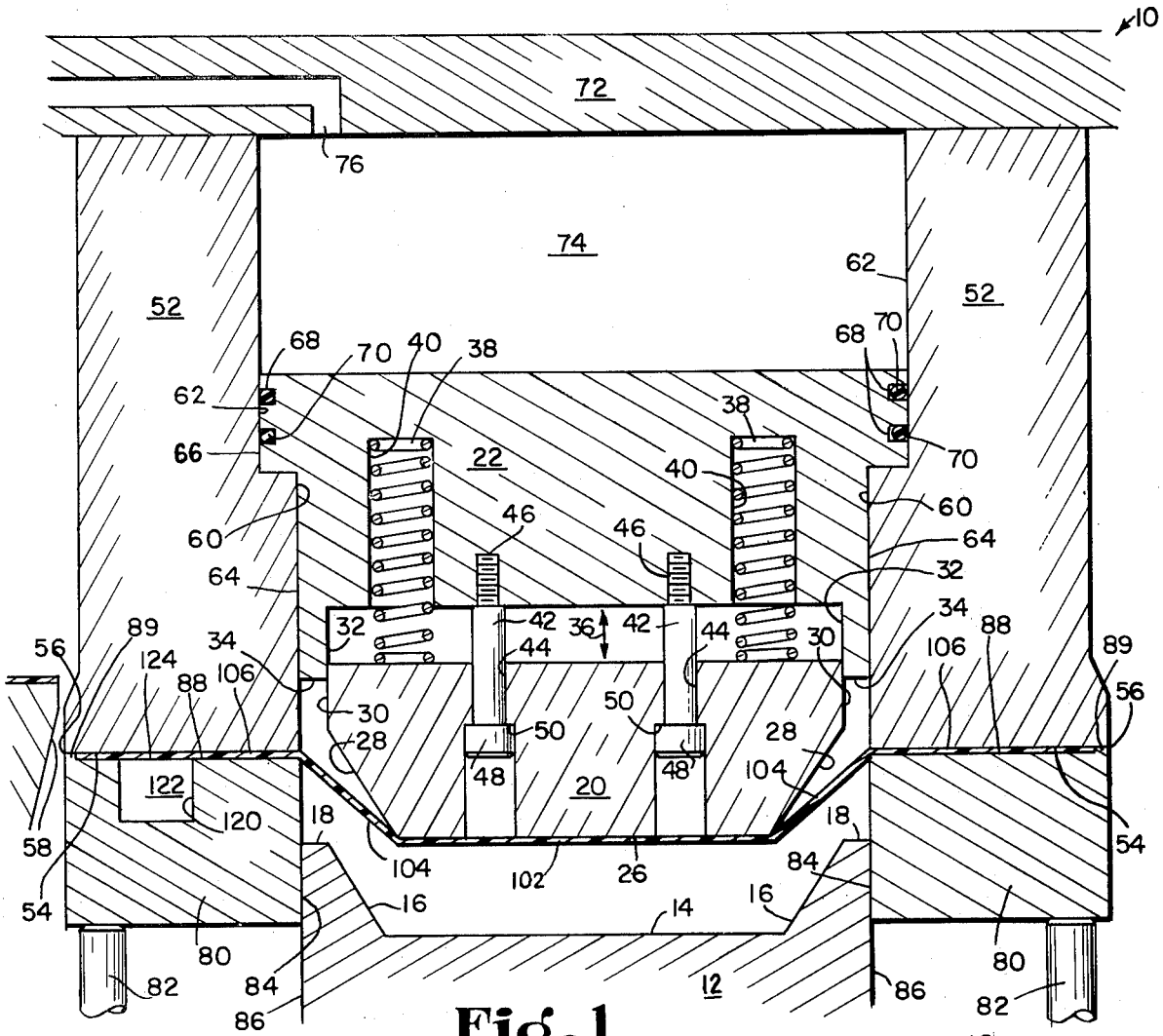
FIGS. 1–2 are fragmentary cross sectional views of a forming press constructed in accordance with the present invention during two phases of the operating sequence of said press.

Referring now to FIGS. 1–6, a forming press 10 conventionally includes a horn or punch 12 which, in the illustrative embodiment, constitutes the basic reference surface or the surface relative to which the rest of the die members move and which provides an upwardly facing die surface including an inner flat circular portion 14, an intermediate conical annular portion 16 and a radially outer peripheral portion 18. Above the horn 12 is a knock-out member 20 having a flat, circular horizontal surface 26 in registry with the die surface 14, a conical surface 28 in registry with the die surface 16 and an outer cylindrical wall 30. The knock-out member 20 is carried by a piston 22 formed with a central cavity providing a cylindrical inner wall 32 telescopically receiving the outer wall 30 of the knock-out member 20. The piston 22 and knock-out member 20 constitute punch means for cooperating with the horn 12 to define a concentric central portion of a lid or a container. The outer peripheral portion of the piston 22 terminates with an annular die surface 34 in registry with the outer peripheral portion 18. In this description and in the claims appended hereto, die members or portions thereof are said to engage other die members or portions thereof. In this context, the term "engaged" is intended to include the engagement of sheet material between the die members or portions thereof.

In this specification and in the claims appended hereto, parts are said to extend "radially" from the center of the forming press. In this context, the term radially and like terms are intended to describe parts which lie along lines extending through the centers of the generally circular cross sections of the die members and draw pads herein discussed.

Conversely, the term "non-radially" and like terms as used in this specification and in the claims appended hereto are intended to describe parts which do not lie along lines extending through the centers of the generally circular cross sections of the die members and draw pads herein discussed.

The arrow 36 of FIG. 1 represents the vertical movement of the knock-out member 20 relative to the piston 22, which movement is resisted in one direction by means of die springs 38 contained in openings 40 in the piston 22 to urge the knock-out member 20 downwardly. The downward movement of the knock-out member 20 is limited by means of bolts 42 which illustratively extend upwardly through holes 44 in the member 20 threadedly to engage the piston 22 as indicated at 46. The enlarged heads 48 of the bolts engage radially and peripherally inwardly extending ledges 50 formed in the openings 44 to limit the downward movement of the knock-out member 20.

The press 10 also illustratively includes a concentric annular upper draw pad 52 providing a draw pad surface 54 extending radially outwardly perpendicularly to the axis of the press. The outer edge 56 of this draw pad surface 54 cooperates with an annular shear ring 58 to cut a circular blank of plastic sheet stock from a strip of sheet stock being fed through the press 10 and lying in a plane generally perpendicular to the axes of the die members and draw pads. The piston 22 reciprocates in the cylindrical bore of the upper draw pad 52 which is formed to define a lower and smaller internal diameter cylindrical wall surface 60 and an upper and larger internal diameter cylindrical wall surface 62. The piston 22 is provided with an outer cylindrical surface 64 telescopically engaging the inner surface 60 and an outer surface 66 telescopically engaging the inner surface 62. Annular grooves 68 are formed in the surface 66 and contain O-rings 70 to provide a seal between the piston 22 and the cylindrical surface 62. An end plate 72 encloses the upper end of the draw pad 52 to define a cylindrical chamber 74 into which driving fluid such as air is admitted through an inlet opening 76 to control the movement of the piston 22.

Press 10 also includes a concentric annular lower draw pad 80 in vertical registry with the upper draw pad 52. This lower draw pad 80, which is supported by an air cushion or spring indicated at 82, has an internal diameter cylindrical surface 84 in registry with the internal surface 60 of the upper draw pad 52 and telescopically movable on the outer cylindrical wall 86 of the horn 12. The draw pad 80 provides an upwardly facing draw pad surface 88, the radially outer portion of which is provided with an upwardly and peripherally extending shoulder 89. Such a shoulder 89 and the draw pad surfaces 54 and 88 are discussed in my prior U.S. Pat. No. 3,584,109. Particularly, the space between the draw pad surfaces 54,88 is controlled by the height of the shoulder 89 which may be, for instance, 20% to 30% less than the thickness of the sheet plastic material which is being cold-formed. Once the material is drawn inwardly off the shoulder 89, the shoulder engaging the downwardly facing surface 54 provides a controlled draw pad spacing, and, consequently, a controlled pressure applied to the thickness of the material. This prevents "pinch off" when the material is on the radially innermost edge of the draw pad surfaces.

Mounted in radially extending, circumferentially narrow slots 120 in the upwardly facing draw pad surface 88 are a plurality of scoring blades 122, each having an exposed scoring edge 124. Scoring blades 122 may, for example, extend radially of draw pad 80 to a length of about one-sixteenth inch to ¼ inch. As shown in detail in FIGS. 3–4, scoring edges 124 may extend further into the space 130 defined between draw pad surfaces 54,88 at its end 125 which is a radially greater distance from the central axis of forming press 10.

In FIG. 1, the sheet of thermoplastic material is shown having an inner circular portion 102 which is disposed between the surfaces 14,16, an annular portion 104 disposed between the surfaces 16,28 and an outer annular portion 106 disposed between the surfaces 54,88.

FIG. 1 shows, therefore, the first phase of the cold-forming sequence for a plastic part. In that first phase, a blank of material (circular) is cut from thermoplastic strip stock at the shear ring 58. The upper draw pad 52 then engages the lower draw pad 80 with the blank therebetween. The knock-out member 20 in FIG. 1 has moved downwardly with the piston 22 and has begun to form a part by forcing downwardly the blank center portions 102,104.

As sections 102,104 of the blank are forced downwardly, the periphery 106 of the blank is drawn inwardly between surfaces 54,88. The draw pads 52,80 exert a carefully controlled pressure on the surfaces of the blank as the material is drawn therebetween. The careful control is due, in part, to the presence of shoulder 89. The carefully controlled pressure at which the blank is drawn across the scoring edge 124 of knife 122 as the forming process begins allows a line of controlled depth to be scored in the surface of blank portion 106.

Figure 2:
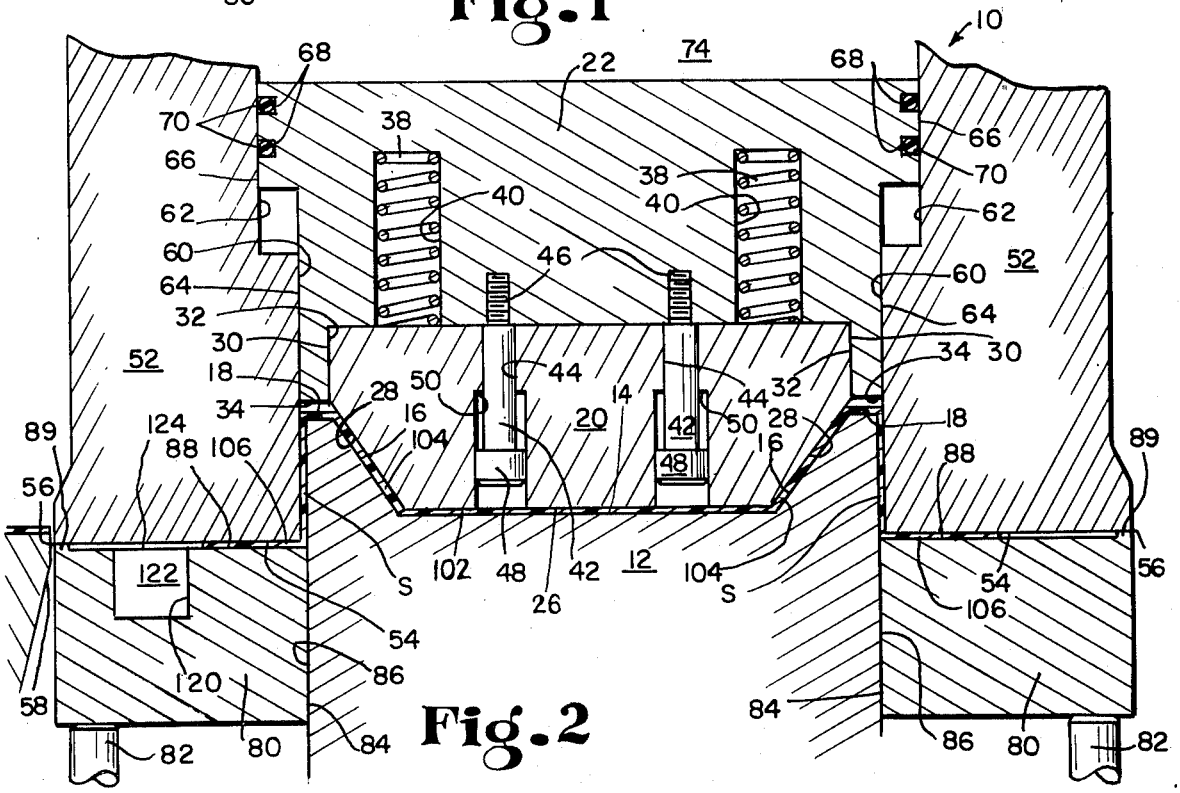

In FIG. 2, an illustration of the second phase of the cold-forming sequence, movement of the upper draw pad 52 downwardly moves the lower draw pad 80 downwardly against the urging of means 82. In press 10, means (not shown) are provided for driving the draw pad 52 downwardly.

In the second phase of the cold-forming sequence, as the draw pads 52,80 move downwardly, the radially outer peripheral edge portion 106 of the blank is drawn first radially inwardly toward the center of press 10 and then downwardly conformably about wall 86 of horn 12 to define a skirt S. As outer annular portion 106 of the plastic sheet is drawn radially inwardly toward the axis of forming press 10 to form skirt S, it continues to be drawn across the scoring edges 124 of scoring blades 122. During the drawing process, the surface of the plastic sheet is cut or scored by edges 124 to a depth controlled by shoulder 89.

Figure 3:
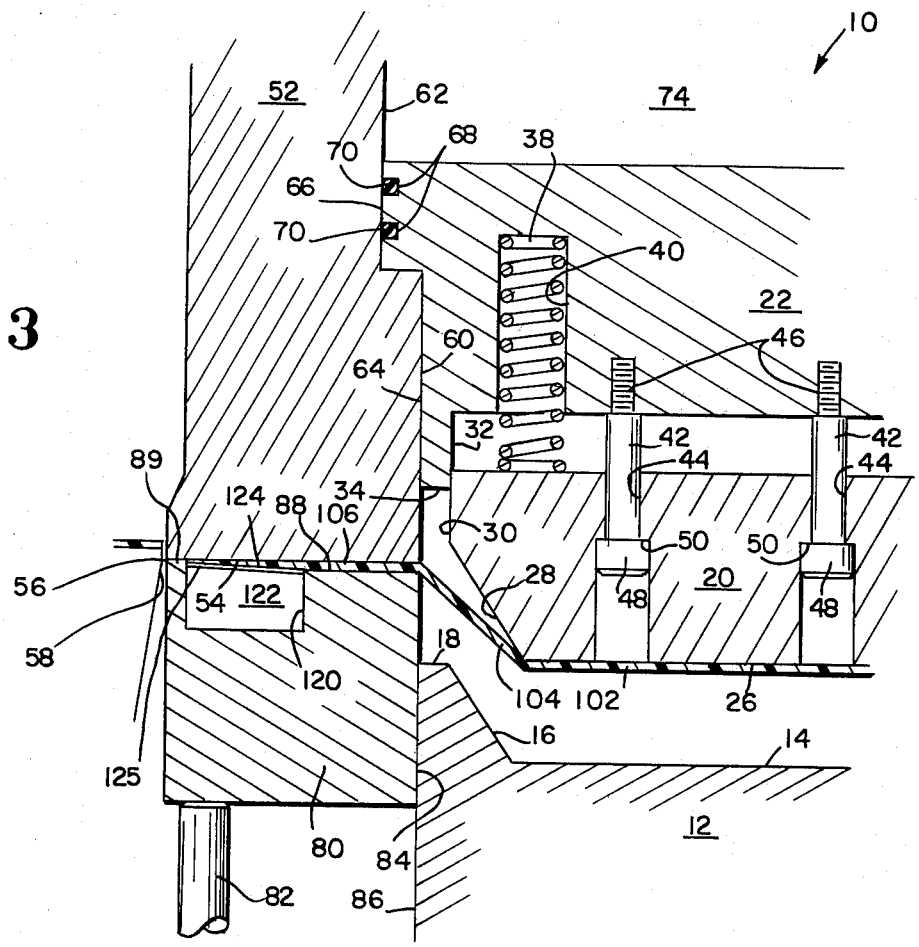
FIG. 3 is a fragmentary sectional view of another forming press constructed in accordance with the present invention.
Figure 4:
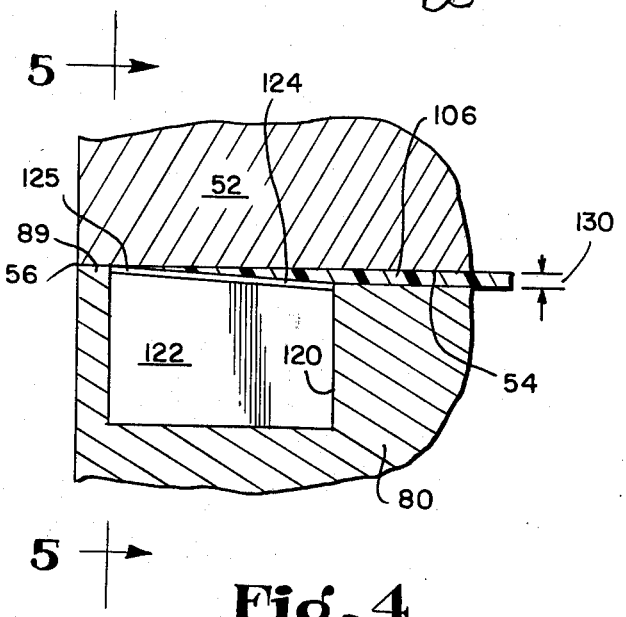
FIG. 4 is a fragmentary sectional veiw of a detail of the press of FIG. 3.
Figure 5:
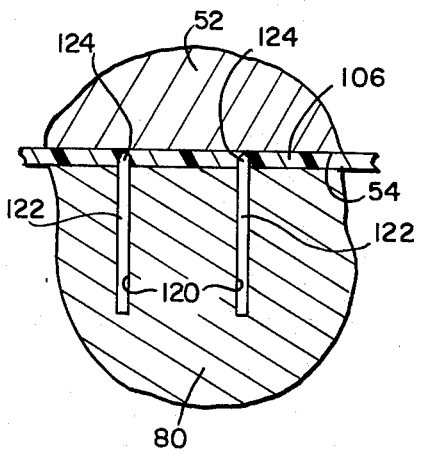
FIG. 5 is a fragmentary view of the detail shown in FIG. 4 along section lines 5—5 thereof.

Referring now to an alternative embodiment of the invention illustrated in FIGS. 3–5, it may be desirable to tilt the radially outward portions 125 of cutting edges 124 upwardly so that, near the radially outward extent 106 of the blank, the scoring line cuts substantially completely through the plastic sheet. Of course, radially inwardly from the edge the sheet is scored but not cut completely through. Since the plastic part made by this process is cut completely through at its outer periphery, it is easy to begin to tear loose the pull-tab thus formed, yet the tab is firmly attached to the part radially inwardly from the edge thereof.

Figure 6:
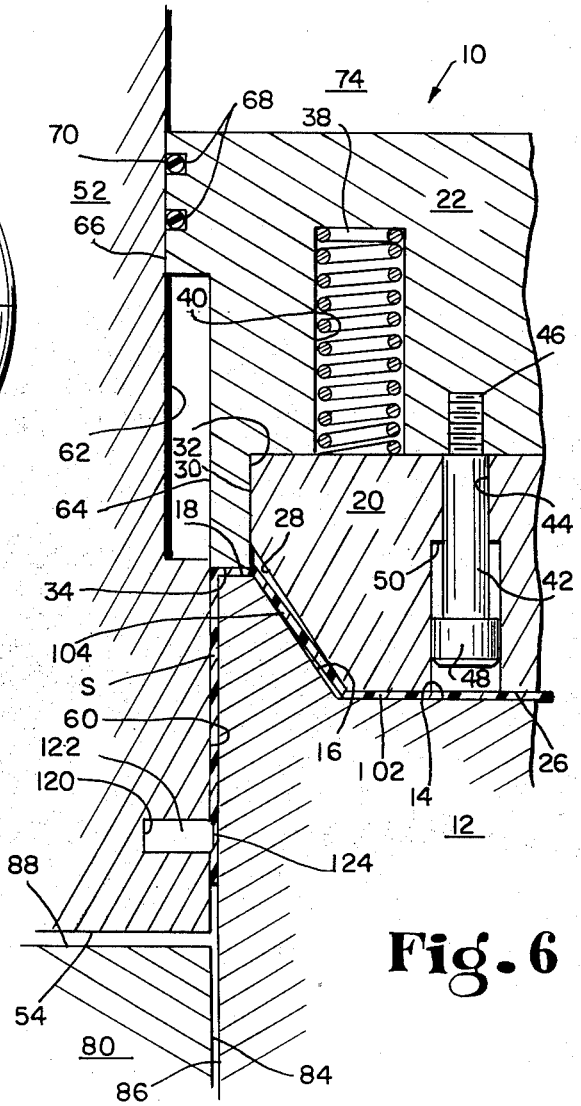
FIG. 6 is a fragmentary sectional view of another forming press constructed in accordance with the present invention.

In the embodiment of the invention illustrated in FIG. 6, the scoring knives 122 are located to provide vertically extending scoring edges 124 on the interior walls 60 of the upper draw pad 52. Thus, in the embodiment of FIG. 6, scoring edges 124 extend generally parallel to the axis of press 10. As the plastic sheet is drawn downwardly between walls 60,86 to form the depending skirt S during the second phase of the forming operation, the scoring edges 124 are pulled downwardly across the surface of the plastic sheet to form the pull-tab.

In the two alternative embodiments illustrated in FIGS. 1–4 and 5, respectively, the scoring will appear on the bottom and top sides, respectively, of the plastic sheet. Of course, the scoring knives can be placed in the downwardly facing surface 54 of draw pad 52 to score the top surface of the plastic sheet. Further, if desired, both the bottom and top surfaces of the blank can be scored at the same time as the plastic part is being formed, e.g., by putting scoring knives in both draw pad surfaces 54,88.

Figure 7:
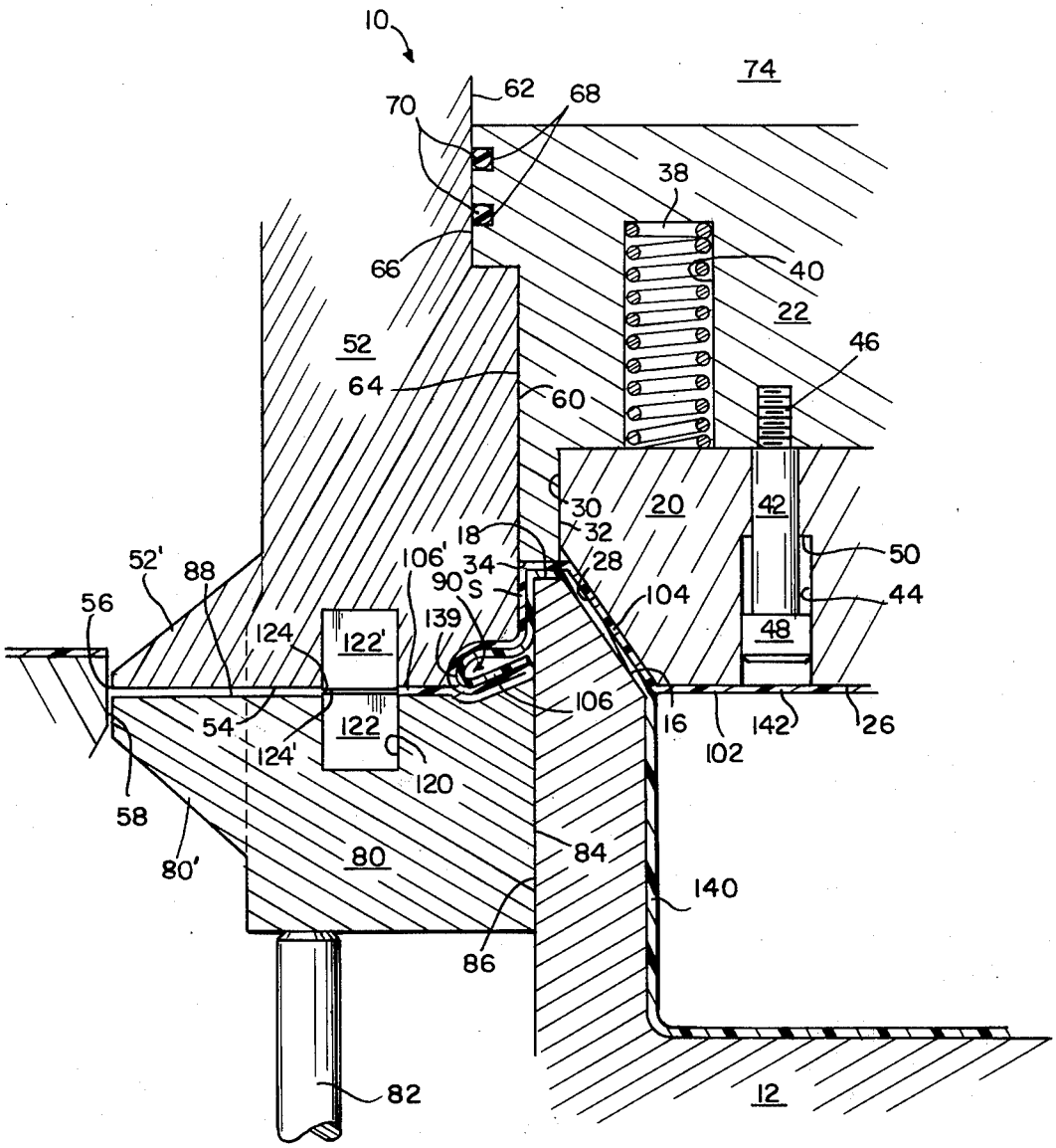
FIG. 7 is a fragmentary sectional view of another forming press constructed in accordance with the present invention.

In FIG. 7, another alternative embodiment of the instant invention, the cold-forming method and apparatus, is being used to form and score a sealing bead 139 to join, about their outer peripheries, a container 140 and a lid 142. Prior to the bead cold-forming process step illustrated in FIG. 7 it is to be understood that major portions of container 140 may have already been formed. In fact, and in a typical case, container 140 and lid 142 may be sealed by cold-forming bead 139 about their outer peripheries with some product already inside container 140.

In the embodiment illustrated in FIG. 7, one surface of each of container 140 and lid 142 is being scored by scoring knives 122,122', respectively, mounted in draw pad surfaces 88,54 respectively. The method whereby sealing bead 139 is formed around the outer peripheries of container 140 and lid 142 is as described in detail in my aforementioned co-pending U.S. patent application Ser. No. 619,377, filed Oct. 3, 1975.

For purposes of this discussion, it will be sufficient to say that the adjacent surfaces of container 140 and lid 142 are buckled into a void 90 which extends annularly about the inner peripheries of draw pads 52,80. Prior to the step of forming sealing bead 139, however, annular portions 106,106' of container 140 and lid 142, respectively, are cold-formed in process steps such as those hereinbefore described. It is during those process steps that the outer peripheries of the container 140, lid 142 are drawn across the scoring edges 124,124' of scoring knives 122,122', respectively. As before, the scoring depth, i.e., the depth of penetration of the scoring edges 124,124' is controlled by controlling the pressure that draw pads 52,80 exert upon the exposed surfaces of container 140 and lid 142. The pressure may be controlled by providing a shoulder (not shown) such as shoulder 89 of the embodiments of FIGS. 1–6, or by controlling the oppositely directed forces, one urging draw pads 52,80 downwardly, and the other, supplied by member 82, urging draw pads 52,80 upwardly.

It should be noted that in this embodiment, extensions 52',80' are provided around the outer peripheries of draw pads 52,80 respectively. These extensions cooperate with the shear ring 58 to provide a pull-tab portion which extends outwardly from the generally circular outer periphery of the part sheared by the shear ring and draw pads of this embodiment. See, e.g., FIGS. 9 and 11.

FIGS. 8–11 illustrate parts fabricated from plastic sheets and scored in accordance with the method and apparatus of the invention. The scoring knives of the apparatus which formed the parts of FIGS. 10–11 were not disposed radially about the center of the forming press but rather were disposed along secants of the circles defined by the peripheries 151,161 of the parts 150,160 of FIGS. 10 and 11, respectively.

Figure 10:
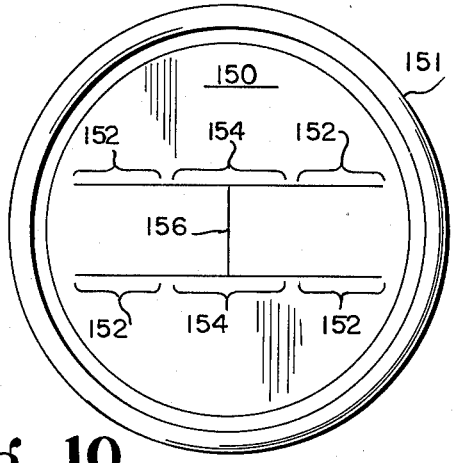
FIGS. 8–11 are parts illustrative of the types of parts which can be made in the presses of FIGS. 1–7 in accordance with the method of the present invention.

The container lid 150 of FIG. 10 has portions 152 of two parallel tabs scored by knives placed in the draw pads in accordance with the present invention. Portions 154 of the two parallel lines and the intersecting line segment 156 are not scored by knives placed in the draw pads, but rather, are coined into the plastic part after the forming operation is completed in the forming press 10.

Figure 11:
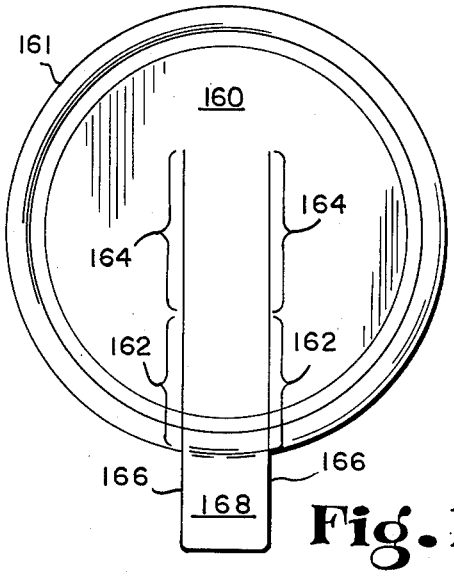

Similarly, the parallel scored line segments 162 of the plastic part 160 of FIG. 11 may be scored into the part by scoring knives on the draw pad areas in accordance with the teachings of the present invention. Line segments 164, which cannot be scored by knives in the draw pads, are coined into the part at the end of the forming operation. The scored lines 162, of course, are extensions of the side edges 166 of a pull-tab 168 with which part 160 is provided. Pull-tab 168 has been formed by an extension of each of die members 52,80 such as extensions 52',80' of FIG. 7 and a cooperating relief or indentation in the shear ring 58 associated therewith.

Figure 8:
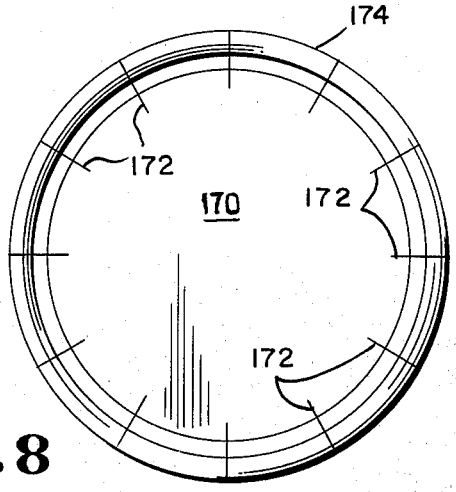

Part 170 of FIG. 8 has been scored along lines 172 which are equally spaced about its outer periphery 174 and extend radially inwardly therefrom. All of lines 172 can be scored by scoring knives placed in one or the other of the draw pads in accordance with the invention.

Figure 9:
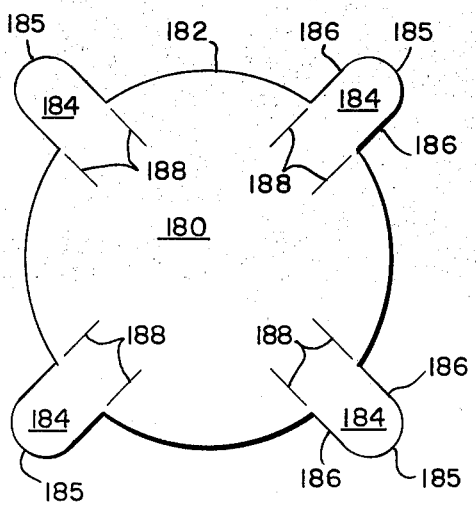

In FIG. 9, a part 180 made in accordance with the method and apparatus of the present invention has a generally circular outer periphery 182. A plurality of pull-tabs 184 extend radially outwardly from the outer periphery and have rounded outer ends 185 and generally straight parallel sides 186. Extending radially inwardly along the surface of part 180 along each side edge 186 at the base of pull-tabs 184 in a score line 188. Lines 188 are scored in the surface of part 180 in accordance with the present invention. Again, the pull-tab portions 184 extending outwardly from the generally circular outer periphery 182 of part 180 are formed by a plurality of extensions such as extensions 52',80' of draw pads 52,80, respectively, of the forming press 10 of FIG. 7, and cooperating reliefs or indentations in shear ring 58 thereof.

It is important to note that a part scored in accordance with the present invention need not necessarily be round, although the parts illustrated in FIGS. 8–11 are all generally round. It should also be noted that the depth of the score in the surface of the plastic part may be controlled precisely by controlling the height of the exposed scoring edge 124 above the oppositely directed faces 54,88 of draw pads 52,80 and by choosing the correct height for shoulder 89. It can further be appreciated that the method and apparatus of the present invention are not limited to scoring which extends radially from the center of the forming press or the part. As can be seen from FIGS. 10 and 11, non-radial, e.g., parallel, lines can be scored with the method and apparatus of the present invention by properly orienting scoring knives 122 in the draw pads 52,80 and by drawing the part surface across the scoring edges 124 in the proper direction. The lengths of the exposed scoring edges 124 may have to be varied to achieve non-radial scoring of the part surface.

What is claimed is:

1. In an apparatus for forming a part from sheet stock, said apparatus comprising a plurality of die members and first and second draw pads for said die members, said die members and said draw pads being telescopically disposed, said die members and draw pads defining a space between their adjacent surfaces, and said draw pads and said die members being relatively movable for forming said part, the improvement comprising means for scoring said sheet as it is drawn through said space during forming of said part.

2. The improvement of claim 1 wherein said scoring means comprises at least one scoring knife mounted in said first draw pad and extending into said space.

3. The improvement of claim 1 wherein said scoring means comprises two scoring knives mounted in said first draw pad and extending into said space.

4. The improvement of claim 1 wherein said apparatus has a central axis along which said die members and draw pads are disposed for relative movement, said axis being generally perpendicular to said sheet, and said scoring means comprises at least one scoring knife mounted in said first draw pad and having an exposed scoring edge extending radially outwardly from said axis and into said space.

5. An apparatus according to claim 4 wherein said scoring means comprises two scoring knives mounted in said first draw pad and having exposed scoring edges extending radially outwardly from said axis.

6. An apparatus according to claim 1 wherein said apparatus has a central axis along which said die members and draw pads are disposed for relative movement, said axis being generally perpendicular to said sheet, and said scoring means comprises at least one scoring knife mounted in said first draw pad and having an exposed scoring edge extending non-radially outwardly from said axis and into said space.

7. An apparatus according to claim 6 wherein said scoring means comprises two scoring knives mounted in said first draw pad and having exposed scoring edges extending non-radially outwardly from said axis.

8. An apparatus according to claim 1 wherein said apparatus has a central axis along which said die members and draw pads are disposed for relative movement, said axis being generally perpendicular to said sheet, and said scoring means comprises at least one scoring knife mounted in said first draw pad and having an exposed scoring edge extending parallel to said axis and into said space.

9. An apparatus according to claim 8 wherein said scoring means comprises two scoring knives mounted in said first draw pad and having exposed scoring edges extending parallel to said axis.

10. Apparatus for forming a blank of sheet stock into a part having at least one surface, said apparatus comprising a plurality of die members and a pair of draw pads defining a space therebetween, said die members being mounted within, and movable with respect to, said draw pads, said movement of said die members for drawing said blank through said space as said part is formed, and means for scoring said surface, said scoring means being mounted in at least one of said draw pads against which said surface moves to extend into said space.

11. A method of scoring a blank of sheet stock as said blank is being formed into a part having at least one surface, said method comprising the steps of engaging said blank between die members, said die members being held within, and telescopically movable with respect to, a pair of draw pads between which said blank is drawn during forming of said part and at least one of said draw pads having scoring means mounted therein, providing relative movement between said die members and draw pads to form said part and to draw said blank between said draw pads and score said surface as said part is formed.

12. The method of claim 11 wherein said scoring means comprises at least one scoring knife mounted in said one of said draw pads, said scoring knife having an exposed scoring edge for engaging said surface for scoring said surface as it is drawn between said draw pads.

13. The method of claim 12 wherein said scoring means comprises two scoring knives mounted in said one of said draw pads, each of said scoring knives having an exposed scoring edge for engaging said surface for scoring said surface as it is drawn between said draw pads.

14. The method of claim 11 wherein said apparatus has a central axis along which said die members and draw pads telescopically move relative to one another, said axis being generally perpendicular to said sheet stock, and said scoring means comprises at least one scoring knife mounted in one of said draw pads and having an exposed scoring edge extending radially from said axis.

15. The method of claim 11 wherein the pressure upon said surface as it is drawn between said draw pads is controlled by means for controlling the forces exerted upon at least one of said pair of draw pads tending to urge said draw pads together.

16. The method of claim 15 wherein said pressure is controlled by means for controlling the oppositely directed forces exerted upon both of said draw pads tending to urge said draw pads together.

17. The method of claim 11 wherein a shoulder is provided on one of said draw pads for limiting the minimum spacing of said pair of draw pads from one another.

18. The method of claim 17 wherein said minimum spacing is in a range of from 20% to 30% less than the thickness of said sheet.

19. The method of claim 11 wherein said apparatus has a central axis along which said die members and draw pads are disposed for relative movement, said axis being generally perpendicular to said sheet stock, and said scoring means comprises at least one scoring knife mounted in one of said draw pads and having an exposed scoring edge extending non-radially from said axis.

20. The method of claim 19 wherein said exposed scoring edge extends parallel to said axis.

21. A method of scoring a part as said part is formed in a forming press, said press comprising a plurality of die members housed in, and telescopically movable with respect to, a pair of draw pads, at least one of said draw pads having scoring means disposed therein, said method comprising the steps of placing said sheet between said die members, disposing said draw pads in intimate contact with the opposite surfaces of said sheet to exert pressure on said surfaces thereby clamping said sheet in said press, selectively moving said die members relative to said draw pads to form said part and to cause said sheet to be drawn between said draw pads in intimate contact with said scoring means.

22. The method of claim 21 wherein said scoring means comprises at least one scoring knife mounted in one of said draw pads and having a scoring edge disposed above the surface of said one of said draw pads.

23. The method of claim 22 wherein said scoring means comprises at least one scoring knife mounted in each of said pair of draw pads.

24. The method of claim 21 wherein said pressure is limited by means for limiting the minimum spacing between said draw pads.

25. The method of claim 24 wherein said pressure limiting means comprises a shoulder on one of said draw pads.

* * * * *